US010428629B2

(12) United States Patent
Liu et al.

(10) Patent No.: US 10,428,629 B2
(45) Date of Patent: Oct. 1, 2019

(54) METHODS AND SYSTEMS FOR DIRECTLY DRIVING A BEAM PUMPING UNIT BY A ROTATING MOTOR

(71) Applicant: Yueli Electric (Jiangsu) Co., Ltd., Kunshan, Jiangsu Province (CN)

(72) Inventors: Hangxian Liu, Kunshan (CN); Rongfan Liu, Kunshan (CN)

(73) Assignee: Yueli Electric (Jiangsu) Co., Ltd., Kunshan (CN)

( * ) Notice: Subject to any disclaimer, the term of this patent is extended or adjusted under 35 U.S.C. 154(b) by 694 days.

(21) Appl. No.: 14/421,366

(22) PCT Filed: Dec. 30, 2014

(86) PCT No.: PCT/CN2014/095604

§ 371 (c)(1),
(2) Date: Feb. 12, 2015

(87) PCT Pub. No.: WO2016/106568

PCT Pub. Date: Jul. 7, 2016

(65) Prior Publication Data

US 2017/0292353 A1 Oct. 12, 2017

(51) Int. Cl.

| | |
|---|---|
| ***E21B 43/12*** | (2006.01) |
| ***E21B 47/00*** | (2012.01) |
| ***F04B 47/02*** | (2006.01) |

(52) U.S. Cl.

CPC ..... *E21B 43/127* (2013.01); *E21B 47/0008* (2013.01); *F04B 47/02* (2013.01)

(58) Field of Classification Search

CPC ..... E21B 43/127; E21B 47/0008

(Continued)

(56) References Cited

U.S. PATENT DOCUMENTS 4,137,489 A * 1/1979 Lipo ..... H02P 27/06 318/722

6,857,474 B2 2/2005 Bramlett et al.

(Continued)

FOREIGN PATENT DOCUMENTS

CA 2403060 A1 4/2003
CA 2442973 A1 3/2004

(Continued)

OTHER PUBLICATIONS

International Preliminary Report on Patentability Chapter I issued by International Bureau dated Jul. 4, 2017 for International Application PCT/CN2014/095604.

(Continued)

*Primary Examiner* — John Fitzgerald
*Assistant Examiner* — Rodney T Frank
(74) *Attorney, Agent, or Firm* — Finnegan, Henderson, Farabow, Garrett & Dunner, LLP

(57) ABSTRACT

Systems and methods are disclosed for extracting underground objects using a beam pumping unit including a rotating motor and one or more cranks coupled to a walking beam enabling the extraction. According to certain embodiments, the method includes receiving, at a control system, one or more input signals; and providing, based on the input signals, one or more control signals to the rotating motor to enable the rotating motor to directly drive the one or more cranks for extracting the underground objects. The method also includes varying, based on the one or more control signals, a rotating speed of the rotating motor based on one or more conditions of the underground objects; and enabling the extraction in a reciprocated manner based on the varying rotating speed of the rotating motor.

12 Claims, 9 Drawing Sheets

(58) Field of Classification Search
USPC ..... 73/152.35
See application file for complete search history.

(56) References Cited

U.S. PATENT DOCUMENTS

| | | | | |
|---|---|---|---|---|
| 2002/0030364 | A1* | 3/2002 | Bosley | F02C 9/56 290/7 |
| 2004/0062657 | A1* | 4/2004 | Beck | E21B 43/126 417/42 |
| 2004/0062658 | A1 | 4/2004 | Beck et al. | |
| 2004/0064292 | A1 | 4/2004 | Beck et al. | |
| 2005/0155759 | A1 | 7/2005 | Bramlett et al. | |
| 2006/0251525 | A1 | 11/2006 | Beck et al. | |
| 2006/0276999 | A1 | 12/2006 | Beck et al. | |
| 2013/0307449 | A1* | 11/2013 | Kobayashi | B60K 6/48 318/400.02 |

FOREIGN PATENT DOCUMENTS

| | | | |
|---|---|---|---|
| CA | 2443010 | A1 | 3/2004 |
| CA | 2443175 | A1 | 3/2004 |
| CA | 2614817 | A1 | 3/2004 |
| CA | 2644149 | A1 | 3/2004 |
| CN | 2667799 | Y | 12/2004 |
| CN | 201265396 | Y | 7/2009 |
| CN | 103452532 | A | 12/2013 |
| CN | 103615217 | A | 3/2014 |
| CN | 203626757 | U | 6/2014 |
| CN | 106030027 | A | 10/2016 |

OTHER PUBLICATIONS

International Search Report and the Written Opinion issued in PCT Application No. PCT/CN2014/095604; dated Apr. 8, 2015 (12 pgs.).

* cited by examiner

METHODS AND SYSTEMS FOR DIRECTLY DRIVING A BEAM PUMPING UNIT BY A ROTATING MOTOR

TECHNICAL FIELD

The present disclosure relates to methods and systems for extracting underground objects, such as liquid, gas, or solid and, more particularly, to methods and systems for directly driving a beam pumping unit by a rotating motor.

BACKGROUND

Many beam pumping units for extracting underground crude oil have an overground driving mechanism for driving a reciprocating piston pump in an oil well. The overground driving mechanism typically includes an alternating-current (AC) electric motor such as an induction motor or an asynchronous motor. In a beam pumping unit, a rotary motion provided by the output shaft of the AC electric motor is converted to a vertical reciprocating motion, also known as the nodding motion, to drive a polished rod for extracting underground oil.

In a conventional beam pumping unit, the conversion of the rotary motion of the output shaft of the AC electric motor to the vertical reciprocating motion utilizes, among other things, a gear speed reducer and a belt. The gear speed reducer and the belt convert a high-speed rotary mechanism to a low-speed rotary mechanism for producing the low-speed vertical reciprocating motion. The AC electric motor, the gear speed reducer, and the belt, produce large-enough torque to drive the load for extracting oil. The gear speed reducer and the belt, however, typically have a short life time and require expensive maintenance. Moreover, the AC electric motor usually receives control signals having a fixed frequency and a fixed voltage from its controller. Consequently, the torque produced by the AC electric motor cannot be adjusted according to, for example, a variation of the load, a variation of the oil level, etc.

In other conventional beam pumping units, a linear motor is used to drive the load for extracting oil. The linear motor's stator and rotor are unrolled so that instead of producing a torque (rotation), the linear motor produces a linear force along its length. But the linear motor is expensive and reduces its commercial value and wide usage in the industry.

Therefore, there is a need for an intelligent beam pumping unit that utilizes a relatively inexpensive direct drive motor to produce large-enough torque to drive the load for extracting underground objects, such as liquid, gas, or solid, adjusts the torque and speed of the motor to increase the amount of liquid or gas extracted, and reduces or eliminates the maintenance effort of the overground driving mechanism.

SUMMARY

The present disclosure includes systems and methods for extracting underground objects using a beam pumping unit including a rotating motor and one or more cranks coupled to a walking beam enabling the extraction. According to certain embodiments, a method includes receiving, at a control system, one or more input signals; and providing, based on the input signals, one or more control signals to the rotating motor to enable the rotating motor to directly drive the one or more cranks for extracting the underground objects. The method also includes varying, based on the one or more control signals, a rotating speed of the rotating motor based on one or more conditions of the underground objects; and enabling the extraction in a reciprocated manner based on the varying rotating speed of the rotating motor.

It is to be understood that both the foregoing general description and the following detailed description are exemplary and explanatory only and are not restrictive of the invention, as claimed.

BRIEF DESCRIPTION OF THE DRAWINGS

Reference will now be made to the accompanying drawings showing example embodiments of the present application, and in which.

DETAILED DESCRIPTION

Reference will now be made in detail to the exemplary embodiments, the examples of which are illustrated in the accompanying drawings. Whenever possible, the same reference numbers will be used throughout the drawings to refer to the same or like parts. The aforementioned and other aspects, solutions, and advantages of the presently claimed subject matter will become apparent from the following descriptions and corresponding drawings. The embodiments further clarify the presently claimed subject matter and shall not be construed to limit the scope of the present claimed subject matter.

Figure 1:
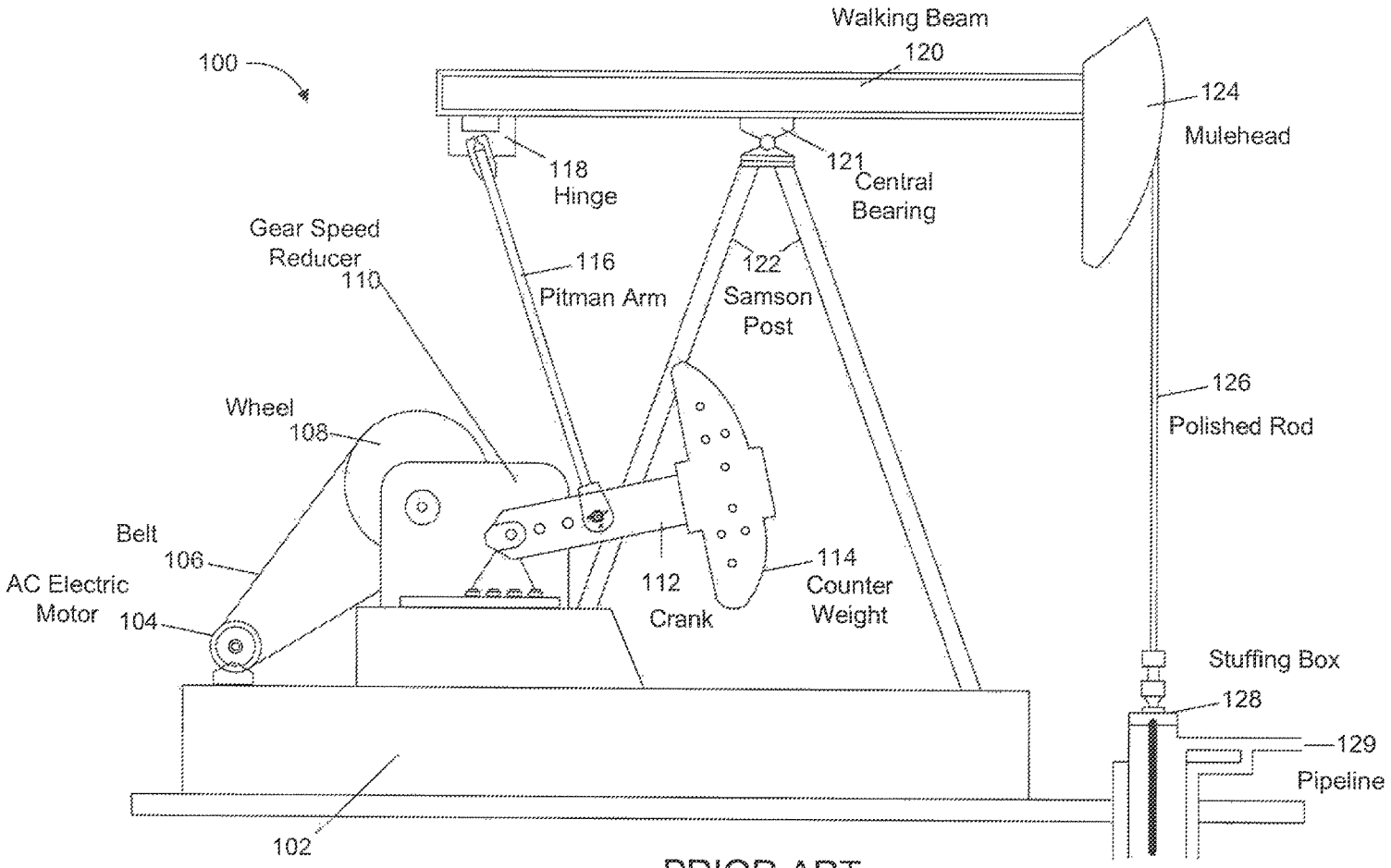
PRIOR ART FIGURE 1
FIG. 1 illustrates a conventional beam pumping unit.

FIG. 1 illustrates a conventional beam pumping unit 100. As shown in FIG. 1, beam pumping unit 100 includes a base 102 for supporting the other structures of beam pumping unit 100. Base 102 is rigidly coupled to an AC electric motor 104. AC electric motor 104 is driven by an alternating current (AC) to produce a rotary motion at its output shaft. AC electric motor 104 operates with two rotating or moving magnetic fields on its rotor and stator respectively. In AC electric motor 104, the poles of the two magnetic fields are pushed or pulled such that the speed of the stator rotating magnetic field and the speed of the rotor rotating magnetic field, which is relative to the speed of the output shaft, maintain synchronism for average torque production.

In FIG. 1, AC electric motor 104 is coupled to a wheel 108 through a belt 106. The rotary motion of the output shaft of AC electric motor 104 is transferred to wheel 108 via belt 106. Wheel 108 is coupled to a gear speed reducer 110. The gear speed reducer 110 includes a gear box for reducing the speed of wheel 108 to a speed suitable for rotating crank 112. The speed of wheel 108 is usually much higher than the rotating speed of crank 112. Gear speed reducer 110 is rotatably coupled to crank 112. Crank 112 is mounted with counter weight 114 to balance the load for extracting oil. Crank 112 is further coupled to the rear end of walking beam 120 through a pitman arm 116 and a hinge 118. The output shaft of speed reducer 110 rotates crank 112 to oscillate walking beam 120. Walking beam 120 is supported by a central bearing 121 located in an intermediate position between the two ends of walking beam 120. Central bearing 121 is hingedly coupled to a Samson post 122, which has two legs with their lower ends fixed to base 102. Samson post 122 supports walking beam 120 such that the front end of walking beam 120 oscillates in an up and down motion, i.e., in nodding motion. The front end of walking beam 120 is mounted with a mulehead 124, which further couples to a polished rod 126 by a bridle and/or a cable (not shown).

Referring to FIG. 1, polished rod 126 extends into an oil well (not shown) through a stuffing box 128 and is further coupled to underground structures (not shown) for extracting oil. Polished rod 126 has a close fit to stuffing box 128. Thus, when mulehead 124 causes polished rod 126 to move up and down through stuffing box 128, the extracted oil cannot escape and can flow to a dedicated pipeline 129. In a conventional beam pumping unit 100, while AC electric motor 104, gear speed reducer 110, and belt 106 may provide a large-enough torque to drive the load for extracting oil, gear speed reducer 110 and belt 106 typically have a short life time and/or require frequent and expensive maintenances. Moreover, AC electric motor 104 usually receives a fixed frequency and a fixed voltage control signal from its controller and therefore its output torque cannot be adjusted according to a variation of the load, a variation of the oil level, etc.

Figure 2:
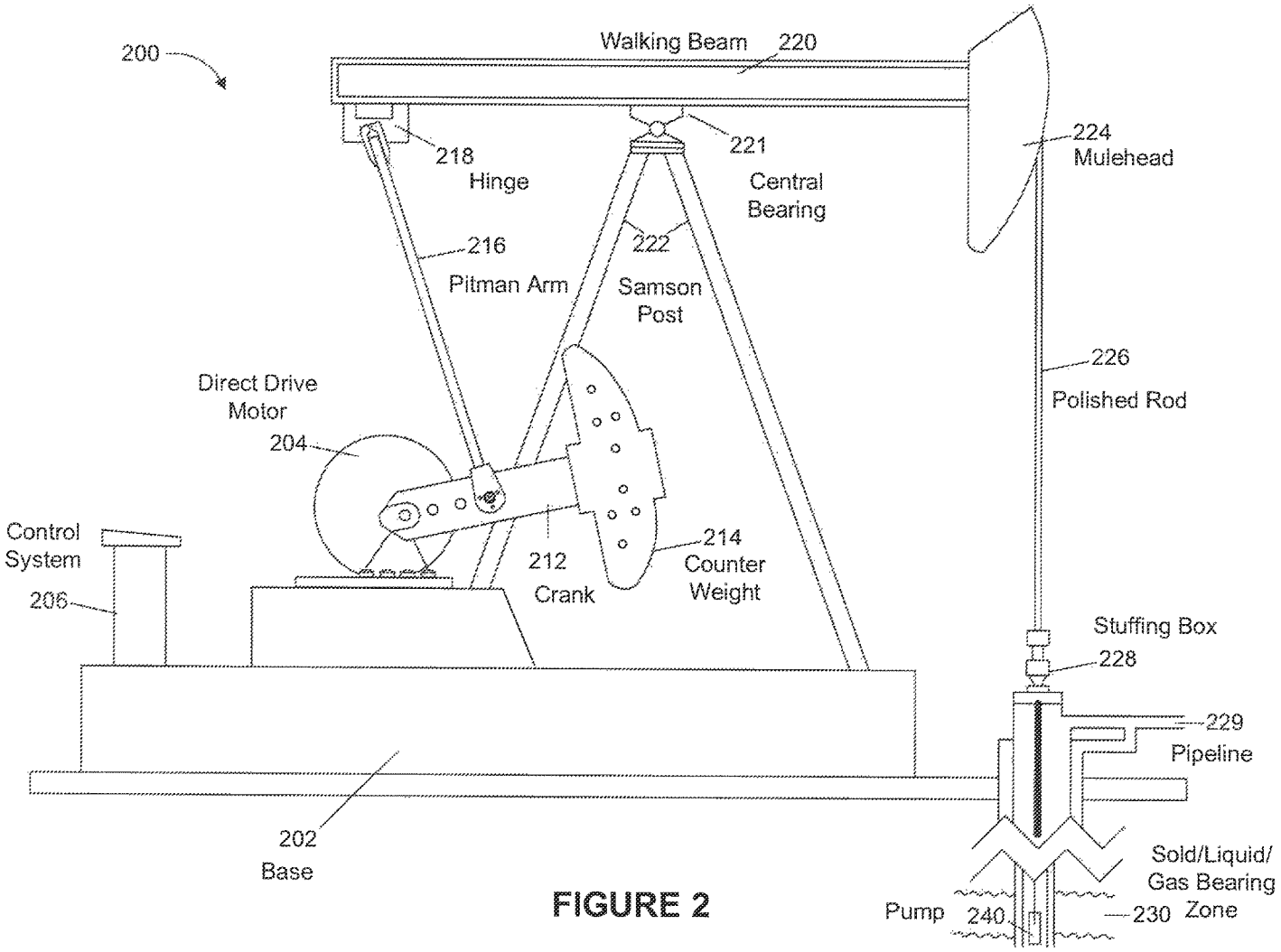
FIG. 2 illustrates an intelligent beam pumping unit directly driven by a rotating motor, consistent with principles of the present disclosure.

FIG. 2 illustrates an intelligent beam pumping unit 200 consistent with principles of the present disclosure. As shown in FIG. 2, intelligent beam pumping unit 200 includes a base 202 for supporting the other components of intelligent beam pumping unit 200. A direct drive motor 204 may be rigidly or fixedly coupled to base 202. Unlike that of AC electrical motor 104 shown in FIG. 1, the output shaft of direct drive motor 204 may be directly and rotatably coupled to one or more cranks 212 without a belt and/or a gear speed reducer. In some embodiments, direct drive motor 204 can provide a sufficiently high torque and a sufficiently low speed suitable for driving one or more cranks 212 for extracting the underground objects, such as liquid, gas, or solid. Direct drive motor 204 may be any rotating motor, e.g., a brushed or brushless electric motor, a synchronous reluctance motor (synRM), a DC motor, a permanent magnetic synchronous motor (PMSM), a compound PMSM, a rotor winding synchronous motor, or an asynchronous motor such as an induction motor or an AC electric motor. Various embodiments of direct drive motor 204 are described further below.

Referring to FIG. 2, intelligent beam pumping unit 200 may include a control system 206. Control system 206 can be supported by base 202 and is electrically coupled to direct drive motor 204. Direct drive motor 204 may be controlled by control system 206. Control system 206 can provide electrical control signals to direct drive motor 204. For example, when direct drive motor 204 includes a PMSM, compound PMSM, or a permanent magnet motor (PMM), control system 206 may provide a VVVF (variable voltage variable frequency) three-phase pulse width modulation (PWM) control signal to the stator of the PMSM, compound PMSM, or PMM. Using the control signals, control system 206 may enable the controlling of the position (e.g., rotor position) and speed (e.g., speed of the output shaft) associated with direct drive motor 204. For providing the control signals, control system 206 may include a power system (e.g., an inverter) realized by a power semiconductor switch such as an insulated-gate bipolar transistor (IGBT) or silicon carbide (SiC) and a control system realized by software in CPU or digital signal processor (DSP). Control system 206 is described in more detail below.

Referring to FIG. 2, direct drive motor 204 may be rotatably or movably coupled to one or more cranks 212. For example, a separate crank 212 may be mounted to the output shaft on each side of direct drive motor 204. Cranks 212 can be mounted with one or more counter weights 214 to balance the load generated by a polished rod 226 extending to a solid/liquid/gas bearing zone 230 and a pump 240. In certain embodiments, liquid/gas bearing zone 230 may be a solid bearing zone. In some embodiments, control system 206 of intelligent beam pumping unit 200 provides position sensorless control, and therefore enables the output shaft on each side of direct drive motor 204 to be rotatably or movably coupled to a separate crank 212. As a result, direct drive motor 204 may provide torque on both sides of its output shaft and may thus be capable of carrying a wide range of load.

As shown in FIG. 2, one or more cranks 212 are further coupled to the rear end of a walking beam 220 through one or more pitman arms 216 and a hinge 218. In some embodiments, the output shaft of direct drive motor 204 can rotate one or more cranks 212 to oscillate walking beam 220. Walking beam 220 may be supported by one or more central bearings 221 located in an intermediate position between the two ends of walking beam 220. One or more central bearings 221 may be hingedly, rotatably, movably, permanently, detachably, or latchably coupled to a Samson post 222, which includes two or more legs having their lower ends fixedly, rigidly, permanently, detachably, or latchably coupled to base 202. Samson post 222 supports walking beam 220 such that the front end of walking beam 220 may oscillate in an up and down motion (e.g., a nodding motion). The front end of walking beam 220 may be mounted with a mulehead 224, which may be further coupled to polished rod 226 by a bridle and/or a cable (not shown).

Referring to FIG. 2, polished rod 226 may extend into an underground liquid/gas bearing zone 230 through a stuffing box 228 for extracting liquid (e.g., oil, water, etc.), gas (e.g., nature gas), or solid (e.g., flowing solid minerals). Polished rod 226 may have a close fit to stuffing box 228. As a result, when mulehead 224 causes polished rod 226 to move up and down through stuffing box 228, the extracted objects may not escape and may flow into a dedicated pipeline 229.

As shown in FIG. 2, the exemplary underground pumping subsystem of intelligent pumping unit 200 may include a pump 240 coupled to the end of polished rod 226. In certain embodiments, polished rod 226 may be coupled to one or more sucker rods, which in turn are coupled to pump 240. Pump 240 may include, for example, a standing valve, a travelling valve, a pump barrel, and/or a sensor for sensing a level of underground objects being extracted. The exemplary underground pumping subsystem of intelligent pumping unit 200 is further described in more detail below.

Figure 3:
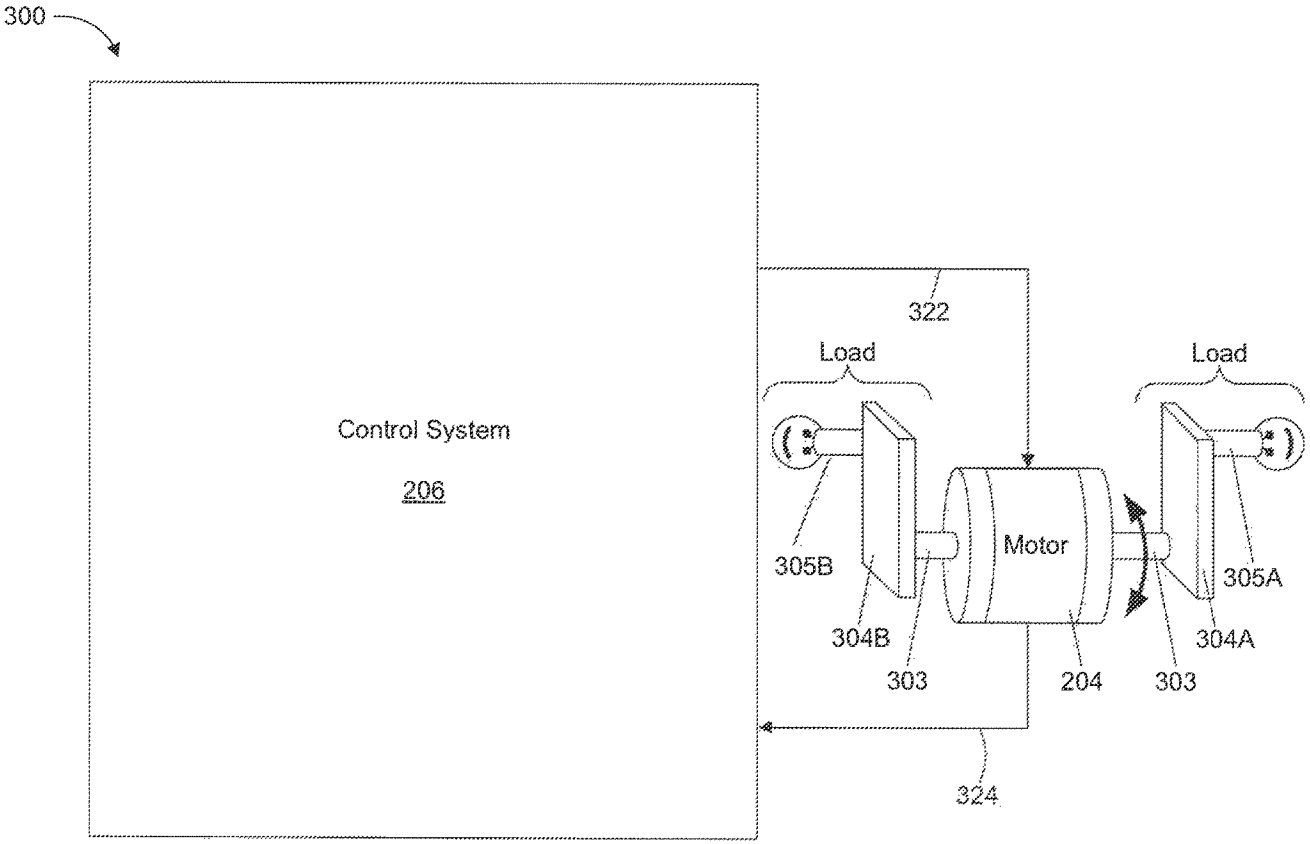
FIG. 3 is a block diagram illustrating a subsystem of an exemplary intelligent beam pumping unit, consistent with principles of the present disclosure.

FIG. 3 is a block diagram illustrating a subsystem 300 of intelligent beam pumping unit 200, consistent with principles of the present disclosure. In some embodiments, subsystem 300 includes a control system 206 coupled to a direct drive motor 204 as shown in FIG. 2. For example, control system 206 may be coupled to direct drive motor 204 via wired and/or wireless signals. Control system 206 can provide control signals 322 including, for example, a three-phase pulse width modulation signal, to control the position (e.g., the angle of the rotor of direct drive motor 204) and the speed (e.g., the speed of the output shaft) associated with direct drive motor 204.

For controlling the position and the speed of motor 204, a motor control system may use a motor position sensor, which includes, for example, an encoder, a decorder or counter, a controller, and an amplifier (not shown). A motor position sensor, such as a Hall-effect position sensor or an optical position sensor, provides the position (e.g., an rotor angle from 0°-360°) to the controller, which generates corresponding control voltage signals or current signals for varying the speed and position associated with the motor. A motor position sensor can include a rotary encoder, which converts the angular position or motion of the output shaft of the motor to an analog signal or a digital signal, such as a binary code. The digital signal may then be decoded by a decoder or counter and provided to the controller. In certain embodiments, for sensing the rotor position, a motor position sensor may be required to be electrically, magnetically, or optically coupled to one end of the output shaft of the motor.

Referring to FIG. 3, in certain embodiments, control system 206 may be a position sensor-less control system. Control system 206 can estimate the position and/or the speed associated with direct drive motor 204 based on one or more calculated motor supply current signals and one or more measured motor supply current signals. The measured motor supply current signals can be obtained based on control signals 322. As a result, control system 300 may not require a position sensor. A position sensor-less control system is described in more detail below.

When control system 206 is a position sensor-less control system, direct drive motor 204 can provide a force or torque in a more flexible manner. For example, as shown in FIG. 3, based on one or more control signals 322 received from control system 206, direct drive motor 204 can provide a torque on both sides of output shaft 303 to carry one or both cranks 304A and 304B. Cranks 304A and 304B may carry load 305A and 305B, respectively. As a result, a position sensor-less control system 206 can enable direct drive motor 204 to provide a torque more flexibly for carrying a wide range of load.

Figure 4:
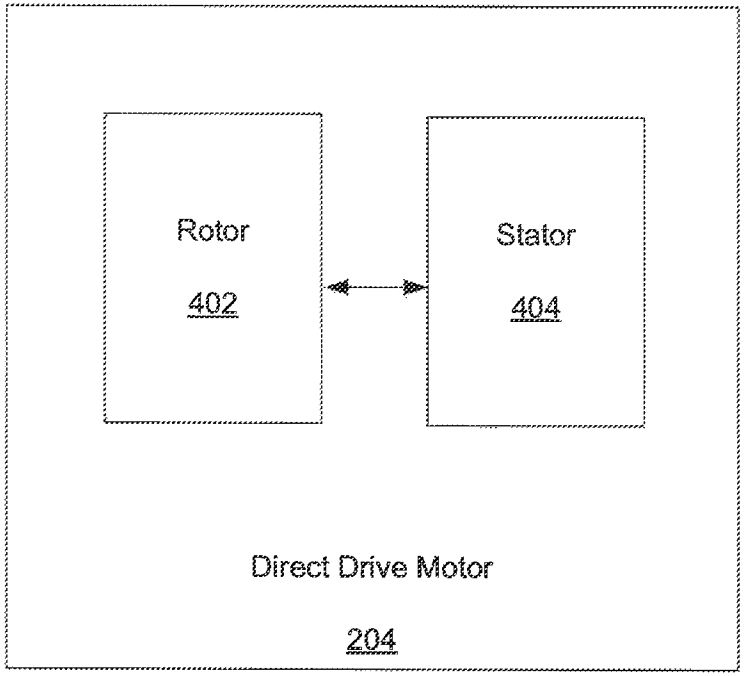
FIG. 4 is a block diagram illustrating a direct drive rotating motor, consistent with principles of the present disclosure.

FIG. 4 is a block diagram illustrating a direct drive motor 204 of FIG. 2, consistent with principles of the present disclosure. Direct drive motor 204 can be any rotating motor. In some embodiments, direct drive motor 204 may include a rotor 402 and a stator 404. One or more of rotor 402 and stator 404 may include electrical windings for receiving motor supply currents and/or permanents magnets (not shown). Magnetic forces generated by stator 404 and/or rotor 402 may drive rotor 402 to rotate. Rotor 402 may be coupled to the output shaft of direct drive motor 204. As a result, rotation of the output shaft of direct drive motor 204 may drive the load of direct drive motor 204.

In certain embodiments, direct drive motor 204 may be a brushless electric motor such as a permanent magnet synchronous motor (PMSM) or a permanent magnet motor (PMM). A brushless electric motor can be driven either by alternating current (AC) or direct current (DC). A brushless electric motor may include a synchronous motor and a control system for operating the motor using one or more motor supply currents. In a synchronous motor, at its steady state, the rotation of its output shaft may be synchronized with the frequency of the one or more motor supply currents and the rotation period is equal to an integral number of AC cycles of the one or more motor supply currents. For driving the output shaft, a synchronous motor may include permanent magnets or electromagnets on the stator of the motor. The permanent magnets or electromagnets can create a magnetic field which rotates in time with the oscillations of the one or more motor supply currents. A synchronous motor may also include a rotor (e.g., rotor 402), which may be mechanically coupled to the output shaft. The rotor may include permanent magnets or electromagnets. When the rotor uses permanent magnets, the electric motor may be a PMSM or a PMM. In a PMSM, the rotor with permanent magnets turns in step with the stator field at the same rate and as a result, provides a second synchronized rotating magnet field.

In certain embodiments, a PMSM or a PMM may include rotors having permanent magnets and stators having three-phase windings (e.g., stator 404). A permanent magnet may be, for example, a neodymium (NdFeB, NIB, or Neo) magnet. The permanent magnets may be mounted on the surface of the rotor such that the magnetic field is radially directed across an air gap between the rotor and the stator. In certain other embodiments, the permanent magnets may be inset into the rotor surface or inserted in slots below the rotor surface. In certain other embodiments, circumferentially directed permanent magnets may be placed in radial slots that provide magnetic flux to iron poles, which in turn set up a radial field in the air gap.

To operate a PMSM or a PMM, an electrical control signal, such as a variable-voltage variable-frequency (VVVF) signal, may be provided to the stator to operate the rotor to rotate in a desired speed. A PMSM or PMM may be controlled to operate at a rotation speed synchronized with a frequency of the one or more motor supply currents. The one or more motor supply currents may be generated based on a supply of a constant or varying voltage. Under natural cooling, fan cooling, and/or water cooling conditions, a PMSM or a PMM may provide, for example, a torque density of 10 $kN \cdot m/m^3$-30 $kN \cdot m/m^3$. Further increasing the torque density may require additional cooling measures.

In some embodiments, direct drive motor 204 may also be a compound PMSM. A compound PMSM may include a PMSM and a permanent magnet coupler. The permanent magnet coupler can operate with one or more rotors (e.g., rotor 402) and one or more stators (e.g., stator 404) of a PMSM as a magnetic gear. The magnetic gear may increase a torque of the PMSM by a desired ratio and also decrease a speed of the PMSM. For example, using the permanent magnet coupler, the output shaft of a compound PMSM may provide an "x" times (e.g., 2-10) higher torque than that of a regular PMSM and an "x" times (e.g., 2-10) lower speed than that of a regular PMSM. In one embodiment, when operating under naturally cooling, fan cooling, and/or water cooling conditions, a compound PMSM may provide a torque density of, for example, 80 $kN \cdot m/m^3$-120 $kN \cdot m/m^3$.

In some embodiments, direct drive motor 204 may be a synchronous reluctance motor (synRM). In some embodiments, a synRM may include rotors (e.g., rotor 402) and stators (e.g., stator 404). The rotors may include, for example, four iron poles with no electrical windings. The stators may include, for example, six iron poles each with a current-carrying coil. In a synRM, forces can be established that may cause iron poles carrying a magnetic flux to align with each other. As an example, in operation of a synRM having six iron poles stators, a current is passed through a first pair of stator coils (e.g., a-a' coils), producing a torque on the rotor aligning two of its poles with those of the a-a' stator poles. The current can then be switched off in the first pair of stator coils (a-a' coils) and switched on to a second pair of stator coils (b-b' coils). This produces a counter-clockwise torque on the rotor aligning two rotor poles with the b-b' stator poles. This process is then repeated with a third pair of stator coils (c-c' coils) and then with a-a' coils. The torque is dependent on the magnitude of the coil currents but may be independent of its polarity. The direction of rotation can be changed by changing the order in which the coils are energized. In some embodiments, a synRM can also have any other pole configurations, such as eight stator poles and six rotor poles.

In a synRM, the currents in the stator coils are usually controlled by semiconductor switches connecting the coils to a direct voltage source. A signal from a position sensor mounted on the shaft of a synRM may be used to activate the switches at the appropriate time instants. In one embodiment of the position sensor, a magnetic sensor based on the Hall effect may be used. The Hall effect involves the development of a transverse electric field in a semiconductor material when it carries a current and is placed in a magnetic field perpendicular to the current. Using the control of the semiconductor switches, a synRM may operate over a varied and controlled speed range.

In some embodiments, direct drive motor 204 may be a direct current (DC) motor. A DC motor includes a stationary set of magnets or stator poles encircled with field coils carrying direct current for producing a stationary magnetic field across a rotor. In a DC motor, a rotor (e.g., rotor 402) or an armature may include a series of two or more of windings of wire wrapped in insulated stack slots around iron poles with the ends of the wires terminating on a commutator. By turning on and off the windings of the rotor or armature in sequence, a rotating magnetic field may be created. The rotating magnetic field interacts with the stationary magnetic fields generated by the stator to create a force on the rotor or armature to rotate. The commutator may allow each rotor or armature winding to be activated in turn.

In some embodiments, direct drive motor 204 may be a rotor winding synchronous motor. As stated above, when a synchronous motor operates at its steady state, the rotation of the rotor (e.g. rotor 402) or the shaft may be synchronized with the frequency of the motor supply currents and the rotation period equals an integral number of AC cycles of the motor supply currents. A rotor winding synchronous motors may include a rotor that uses insulated winding connected through slip rings or other mechanisms to a source of direct current. In some embodiments, a rotor winding synchronous motors may also include windings on the stator (e.g., stator 404) of the motor that create a magnetic field which rotates in time with the oscillations of a three-phase alternating current supplied to the stator.

In a rotor winding synchronous motor, the stator current may establish a magnetic field rotating at, for example, 120 f/p revolutions per minute, where "f" is the frequency and "p" is the number of stator poles. A direct current in a p-pole field winding on the rotor may also produce a magnetic field rotating at rotor speed. If the motor carries no load, the stator magnetic field and the rotor magnetic field may align with each other. As the load increases, the rotor may slip back with respect to the rotating magnetic field of the stator. The angle between the stator magnetic field and the rotor magnet field increases as the load increases. In certain embodiments, the maximum torque a rotor winding synchronous motor can provide correspond to when the angle by which the rotor magnetic field lags the stator magnetic field by a 90°.

In some embodiments, direct drive motor 204 may be an asynchronous motor such as an induction motor or an AC electric motor. An asynchronous motor may or may not be capable of providing sufficiently large torque or sufficiently low speed for operation of intelligent beam pumping unit 200. In other embodiments, an asynchronous motor or an induction motor may be used to drive one or more cranks 212 if the load condition permits. In other embodiments, direct drive motor 204 can also be any other suitable rotating motor that may provide a sufficient torque and speed to operate intelligent beam pumping unit 200.

Figure 5:
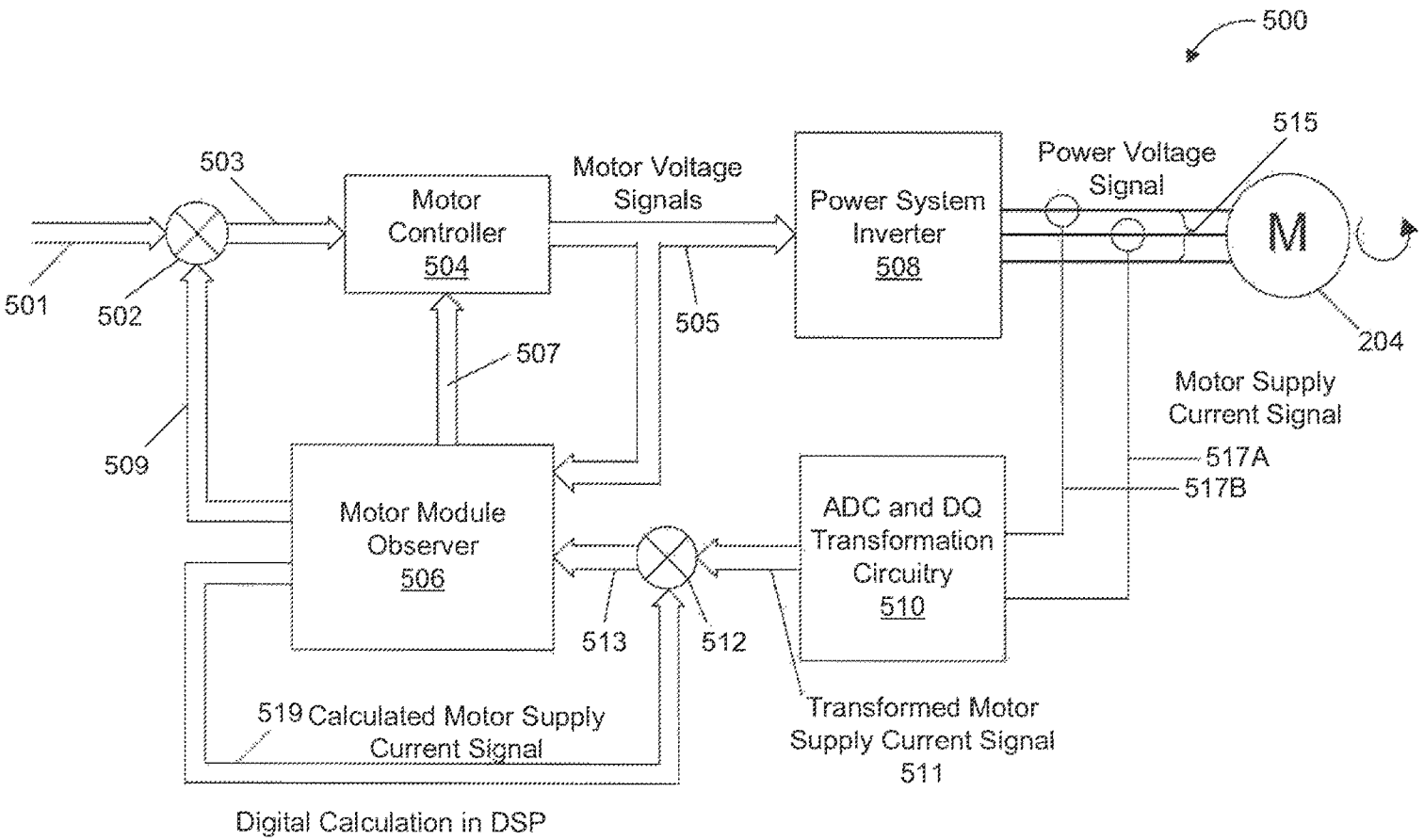
FIG. 5 is a detailed block diagram illustrating an exemplary position sensor-less control system, consistent with principles of the present disclosure.

FIG. 5 is a detailed block diagram illustrating an exemplary position sensor-less control system 500, consistent with principles of the present disclosure. In some embodiments, position sensor-less control system 500 may include a motor controller 504, a motor module observer 506, a power system inverter 508, and an analog-to-digital converter (ADC) and direct quadrature (DQ) transformation circuitry 510. Referring to FIG. 5, position sensor-less control system 500 receives input signals 501. Input signals 501 may be, for example, one or more digital control signals representing the desired motor supply currents for operating direct drive motor 204 of FIG. 2. Input signals 501 may be provided by a host computer, an electrical control panel, or a remote control system (not shown) as part of a control program.

Referring to FIG. 5, signals 503 may be initially based only on input signals 501. During the operation of position sensor-less control system 500, signals 503 may be based on one or both input signals 501 and feedback signals such as signals 509. Signals 503 may be digital signals. Using signals 503, motor controller 504 may generate motor voltage signals 505. Motor voltage signals 505 may include one or more dedicated regulation voltages corresponding to the desired motor supply currents. Power system inverter 508 receives motor voltage signals 505 and converts motor voltage signals 505 to one or more power voltage signals 515. Power system inverter 508 can be a semiconductor switch such as IGBT or SiC that converts DC power voltage signals to AC power voltage signals. For example, power system inverter 508 can convert motor voltage signals 505, which may be DC signals, to a three-phase pulse width modulation voltage signal, which may be an AC power voltage signal. In some embodiments, power system inverter 508 can also convert any type of AC/DC signals to any other type of AC/DC signals for operating direct drive motor 204.

As shown in FIG. 5, based on power voltage signal 515, two phases of the motor supply current signal 517A/B of direct drive motor 204 can be measured or otherwise derived by, for example, ADC and DQ transformation circuitry 510. The measured two-phase motor supply current signal 517A/B may be an analog signal and thus ADC (analog to digital converter) and DQ transformation circuitry 510 may convert measured two-phase motor supply current signal 517A/B to its digital representations. ADC and DQ transformation circuitry 510 may further apply a DQ transformation to the digital representations of the measured two-phase motor supply current signal 517A/B. A DQ transformation is a transformation that rotates the reference frame of three-phase systems to simplify the analysis of three-phase signals. Applying the DQ transformation reduces the three AC quantities to two DC quantities. Simplified calculations can then be carried out on these DC quantities before performing the inverse transform to recover the actual three-phase AC results. As shown in FIG. 5, applying DQ transformation, ADC and DQ transformation circuitry 510 can convert the measured two-phase motor supply current signal 517A/B to a transformed motor supply current signal 511, which may be a digital signal with DC quantities.

Referring to FIG. 5, in some embodiments, motor module observer 506 may also receive motor voltage signals 505 or copies or samples of the motor voltage signals 505. Based on received motor voltage signals 505, motor module observer 506 can calculate information associated with the motor supply currents of direct drive motor 204 (e.g., the motor supply currents provided to outer stator 466 of direct drive motor 204) and generate a calculated motor supply current signal 519. In some embodiments, a comparator (not shown) at node 512 compares transformed motor supply current signal 511 with calculated motor supply current signals 519 and generates a gap signal 513. Gap signal 513 represents the difference of the calculated motor supply currents and measured motor supply currents. Based on gap signal 513, motor module observer 506 can generate a compensation signal 509 to dynamically modify input signals 501 at a node 502 such that signals 503 are compensated. Based on the compensated signals 503, motor controller 504 can generate compensated motor voltage signals 505, which enables the reducing of the difference between the calculated motor supply currents and measured motor supply currents (e.g., reducing or minimizing gap signal 513). The process of reducing the difference between the calculated motor supply currents and measured motor supply currents may be repeated.

Referring to FIG. 5, in some embodiments, when the quantity of gap signal 513 is less than a threshold quantity, motor module observer 506 can calculate position (e.g., an angle of inner rotor 462) and speed (e.g., a speed of magnetic modulation ring 464 or a speed of output shaft of direct drive motor 204) information associated with direct drive motor 204 and provide position and speed signals 507 to motor controller 504 for generating proper motor voltage signals 505. In some embodiments, motor controller 504, motor module observer 506, and nodes 502 and 512 may be implemented in a digital signal processor or a general purpose processor.

Figure 6A:
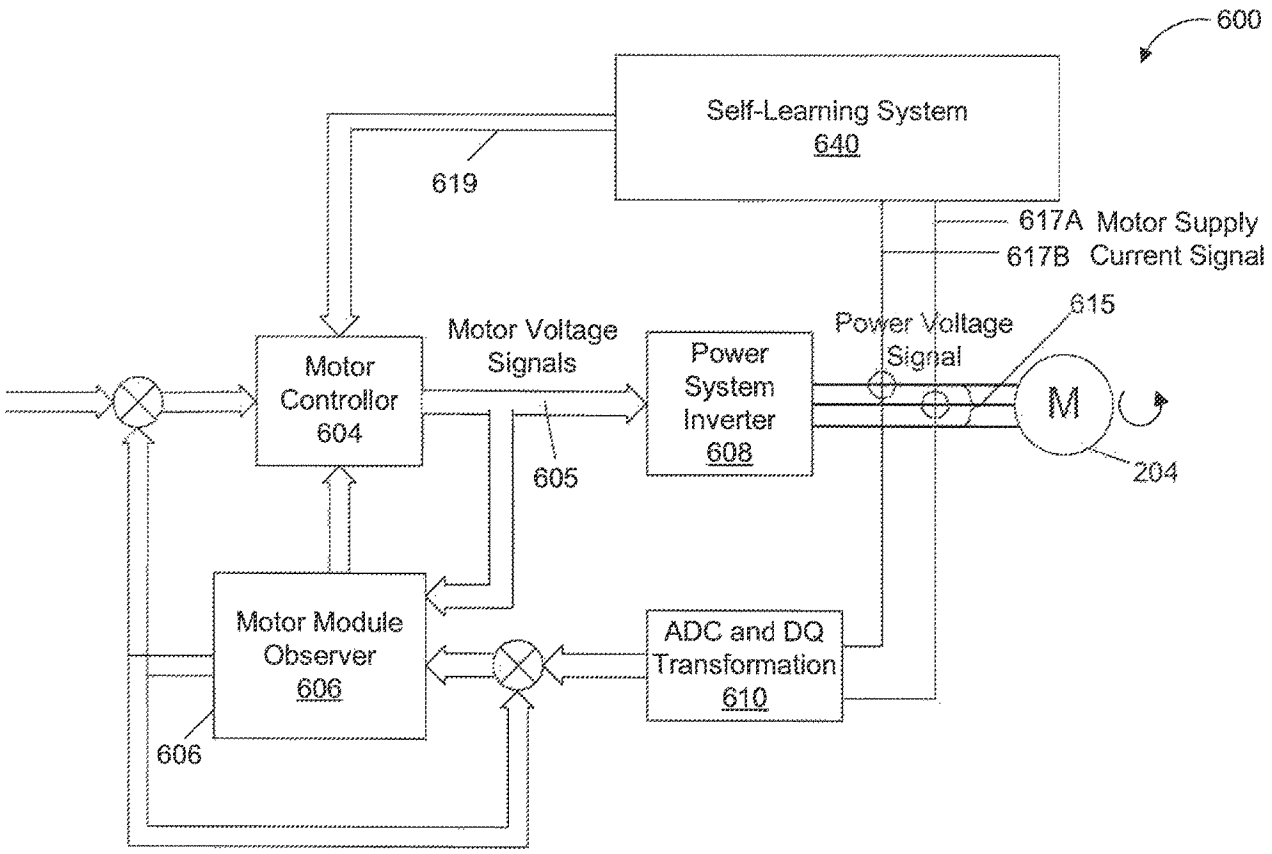
FIG. 6A is a detailed block diagram illustrating another exemplary position sensor-less rotor control mechanism incorporating a self-learning system, consistent with principles of the present disclosure.

FIG. 6A is a detailed diagram illustrating another exemplary position sensor-less rotor control system 600 incorporating a self-learning system 640, consistent with principles of the present disclosure. Referring to FIG. 6A, similar to position sensor-less rotor control system 500, position sensor-less rotor control system 600 may include a motor controller 604, a motor module observer 606, a power system inverter 608, and ADC and DQ transformation circuitry 610. Position sensor-less rotor control system 600 may also include a self-learning system 640. While FIG. 6A illustrates that self-learning system 640 is a separate component from the remaining components of position sensor-less rotor control system 600, self-learning system 640 may also be integrated with the one or more of the remaining components shown in FIG. 6A or other components of intelligent beam pumping unit 200. For example, self-learning system 640 may be integrated with motor module observer 606 and/or ADC and DQ transformation circuitry 610.

In some embodiments, self-learning system 640 can obtain control information associated with direct drive motor 204 of FIG. 2 based on the measurement of a two-phase motor supply current signal 617A/B. Referring to FIG. 6A, motor controller 604 generates motor voltage signals 605. Power system inverter 608 receives motor voltage signals 605 and can convert motor voltage signals 605 to power voltage signal 615. Similar to power system inverter 508, power system inverter 608 is an electronic device or circuitry that converts DC signals to AC signals. For example, power system inverter 608 can convert motor voltage signals 605, which may be DC signals to power voltage signal 615, which may be a three-phase AC power voltage signal. In some embodiments, power system inverter 608 can also convert any type of DC signals to any type of AC signals for operating direct drive motor 204.

As shown in FIG. 6A, based on power voltage signal 615, a two-phase motor supply current signal (e.g., signal 617A/B) can be derived or measured by, for example, self-learning system 640. Self-learning system 640 can perform an online estimation, e.g., apply a signal or spectrum treatment on the measured two-phase motor supply current signal 617A/B, to acquire or derive information associated with the direct drive motor, such as the operation parameters of the direct drive motor. Such parameters may include, for example, a rotor angle, a rotation speed, a rotor resistance, a stator resistance, a leakage inductance, a d-axis reactance, a q-axis reactance, nominal supply currents, a nominal torque, magnetic fields coefficients, one or more parameters of a Kalman filter such as the noise covariances. There are various online estimation techniques for acquiring or deriving such parameters. For example, self-learning system 640 may perform online estimation based on Kalman filter algorithm implemented on a digital signal processor or any other suitable hardware and/or software structures. Using the Kalman filter algorithm, noise covariance, rotor resistance, and/or other operation parameters of the direct drive motor can be calculated or derived based on a feedback electrical signal from the motor receiving a control signal. In certain embodiments, other algorithms can also be used.

Moreover, in some embodiments, position sensor-less control systems 500 or 600 can enable the controlling of the direct drive motor in a more efficient manner. For example, motor module observer 506 or 606 can calculate the position and speed information associated with the direct drive motor within a short period of time, such as about 0.3 second.

Moreover, position sensor-less control systems 500 or 600 may also enable intelligent control of the direct drive motor based on the load conditions. As an example, during an early stage of extracting underground objects such as liquid, gas, or solid, position sensor-less control systems 500 or 600 may automatically increase the rotation speed of the direct drive motor. As a result, intelligent beam pumping unit 200 may be enabled to extract more underground objects (e.g., 30% more) than a conventional beam pumping unit 100. During a middle or late stage of extracting underground liquid or gas, the amount of available underground objects usually reduces. Position sensor-less control systems 500 or 600 may automatically decrease the rotation speed of the direct drive motor, thereby reducing the cost of operating intelligent beam pumping unit 200 while maintaining or increasing the exaction of the underground objects. The controlling of speed of the direct drive motor based on the load conditions are further described in more details below.

Figure 6B:
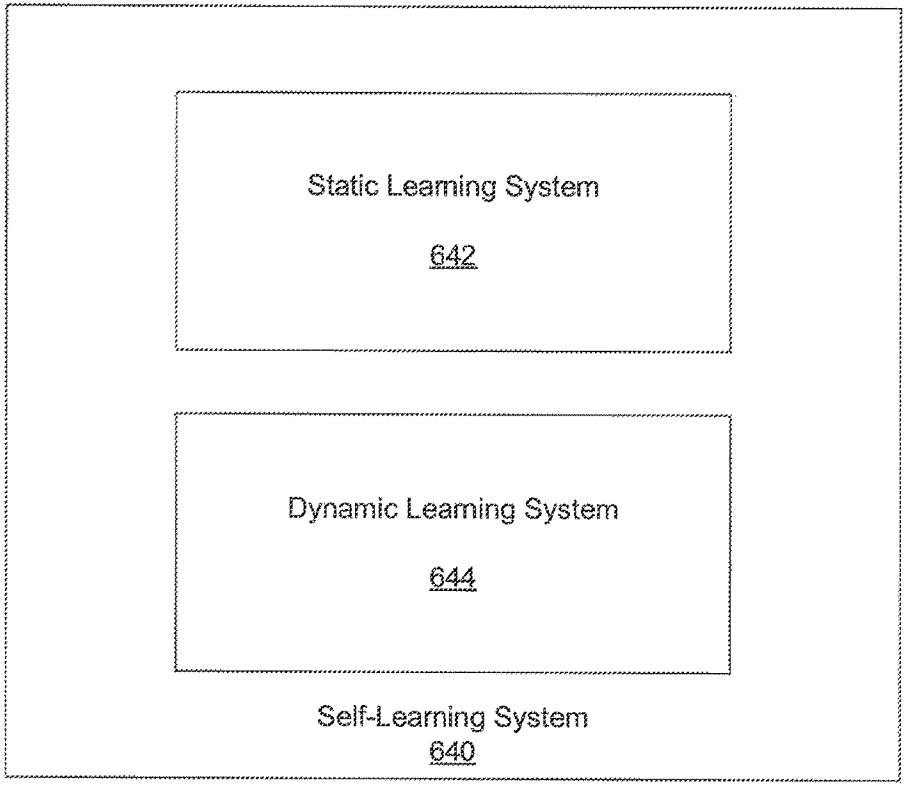
FIG. 6B is a block diagram illustrating an exemplary self-learning system.

FIG. 6B is a block diagram illustrating an exemplary self-learning system 640. Referring to FIG. 6B, in some embodiments, self-learning system 640 can include a static learning subsystem 642 and a dynamic learning subsystem 644. One or more of self-learning system 640, static learning subsystem 642, and dynamic learning subsystem 644 may include one or more processors (such as a general purpose processor or a digital signal processor) and memory. The memory can be a non-transitory computer-readable storage medium. Static learning subsystem 642 can acquire information associated with direct drive motor 204 without initiating or operating direct drive motor 204. Static learning subsystem 642 can store previously collected data, such as the measured two-phase motor supply current signals of direct drive motor 204. Based on the stored data, static learning subsystem 642 can acquire or derive various operation parameters of direct drive motor 204.

Referring to FIGS. 6A and 6B, dynamic learning subsystem 644 can acquire information associated with direct drive motor 204 of FIG. 2 when the direct drive motor is in operation. In some embodiments, dynamic learning subsystem 644 can acquire information associated with the direct drive motor based on real time measurements of motor supply current signal 617A/B. As a result, dynamic learning subsystem 644 can acquire or derive updated or recent operation parameters of the direct drive motor. In some embodiments, static learning subsystem 642 and dynamic learning subsystem 644 can be integrated as one single subsystem. Further, static learning subsystem 642 and dynamic learning subsystem 644 may also be implemented using digital signal processors or general purpose processors.

Self-learning system 640 may reduce the difficulty of controlling, adjusting, or tuning the direct drive motor, because it can automatically adjust or change operation parameters of the direct drive motor based on historical data and/or real time data associated with the operation of the direct drive motor.

Various embodiments of the control system (e.g., control system 206, 500, and 600) and self-learning system (e.g., self-learning system 640) herein may include computer-implemented methods, tangible non-transitory computer-readable mediums, and systems. The computer-implemented methods can be executed, for example, by at least one processor that receives instructions from a non-transitory computer-readable storage medium. Similarly, systems consistent with the present disclosure can include at least one processor and memory, and the memory can be a non-transitory computer-readable storage medium. As used herein, a non-transitory computer-readable storage medium refers to any type of physical memory on which information or data readable by at least one processor can be stored. Examples storage media include random access memory (RAM), read-only memory (ROM), volatile memory, non-volatile memory, hard drives, CD ROMs, DVDs, flash drives, disks, and any other known physical storage medium. Singular terms, such as "memory" and "computer-readable storage medium," can additionally refer to multiple structures, such a plurality of memories or computer-readable storage mediums. As referred to herein, a "memory" can comprise any type of computer-readable storage medium unless otherwise specified. A computer-readable storage medium can store instructions for execution by at least one processor, including instructions for causing the processor to perform steps or stages consistent with an embodiment herein. Additionally, one or more computer-readable storage mediums can be utilized in implementing a computer-implemented method. The term "computer-readable storage medium" should be understood to include tangible items and exclude carrier waves and transient signals.

Figure 7:
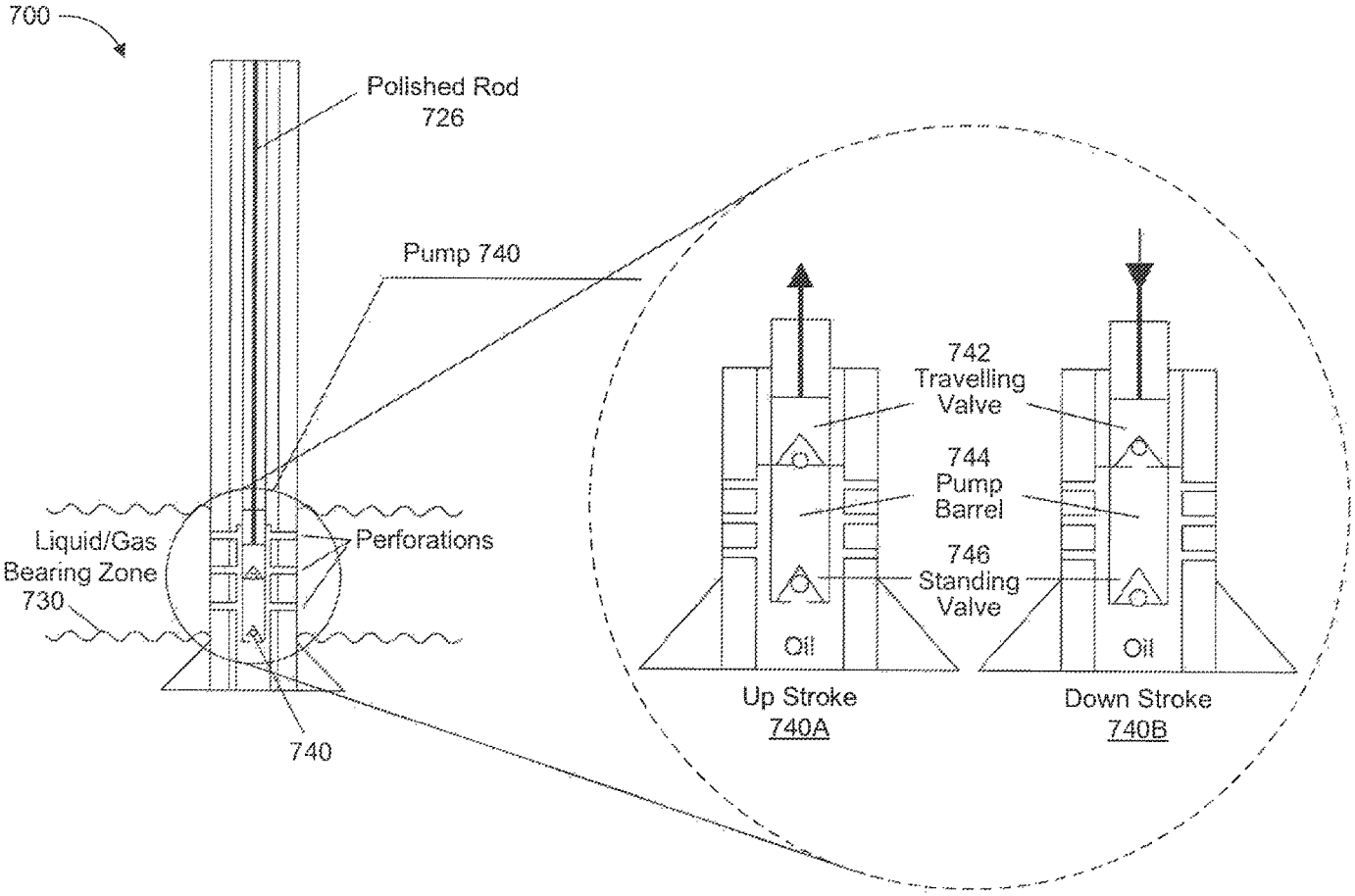
FIG. 7 is a detailed diagram illustrating an underground pumping subsystem.

FIG. 7 is a detailed diagram illustrating an underground pumping subsystem 700 of intelligent beam pumping unit 200. Referring to FIG. 7, underground pumping subsystem 700 include a portion of polished rod 726, which extends from overground to underground liquid/gas bearing zone 730. In some embodiments, underground liquid/gas bearing zone 730 may be an underground solid bearing zone. Polished rod 726 mechanically couples to a pump 740. Pump 740 includes two valves, for example, a travelling valve 742 and a standing valve 746. In some embodiments, standing valve 746 is located below the travelling valve 742. Travelling valve 742 is coupled to the end of polished rod 726, which may include sucker rods and may travel up and down as polished rod 726 travels.

As shown in FIG. 7, in some embodiments, travelling valve 742 may initially be in close proximity with standing valve 746. When polished rod 726 moves up in an up stroke, travelling valve 742 and standing valve 746 may begin to separate from each other as travelling valve 742 moves up. In an up stroke, travelling valve 742 may close and standing valve 746 may open. As a result, pump barrel 744 may be filled with underground objects such as liquid, gas, or solid perforated from liquid/gas bearing zone 730. In an up stroke, pump barrel 744 travels up and the liquid/gas is lifted to overground. When polished rod 726 moves down in a down stroke, travelling valve 742 may open and standing valve 746 may close. Travelling valve 742 may moves down towards standing valve 746. After polished rod 726 reaches the end of its down stroke, the up stroke process repeats.

Referring to FIGS. 5, 6A, 6B, and 7, in some embodiments, position sensor-less control systems 500 or 600 can dynamically adjust the rotation speed of direct drive motor 204 of FIG. 2 to cause the travelling speed of polished rod 726 to be adjusted. As an example, to increase the amount of underground objects such as liquid, gas, or solid that can be extracted from one reciprocate motion including one up stroke and one down stroke, the travelling speed of down stroke may need to be lower than that that of the up stroke. A slower down stroke may allow more underground objects to perforate into pump barrel 744. A faster up stroke may allow a higher upward travelling speed and therefore more reciprocate motions may be performed during a certain period of time. As a result of slower down stroke and faster up stroke, the amount of the underground objects that can be extracted from one reciprocate motion may be increased.

In some embodiments, sensor-less control systems 500 or 600 may adjust the speed of the up and down stroke based on the level of the underground objects such as liquid, gas, or solid. For example, as the underground objects are extracted over time, the level of the underground objects may gradually decrease. As a result, maintaining the same speed of the up and down stroke may reduce the amount of the underground objects over time because more time may be required for liquid/gas to perforate into pump barrel 744 as the level of liquid or gas decreases. In some embodiments, sensor-less control systems 500 or 600 can detect the change of the level of the underground objects. As an example, a liquid/gas sensor (not shown) can be mounted on pump 740 and/or polished rod 726 for providing sensing signals to sensor-less control systems 500 or 600. As another example, self-learning system 640 can detect and/or monitor the change of operation parameters associated with the direct drive motor (e.g., a loading change), and derive underground objects information indicating the change of level of the underground objects such as liquid, gas, or solid being extracted. After detecting the changing of level of the underground objects, sensor-less control systems 500 or 600 may adjust the speed of the up and down stroke of polished rod 726 by adjusting, for example, power voltage signals 515 or 615.

Figure 8:
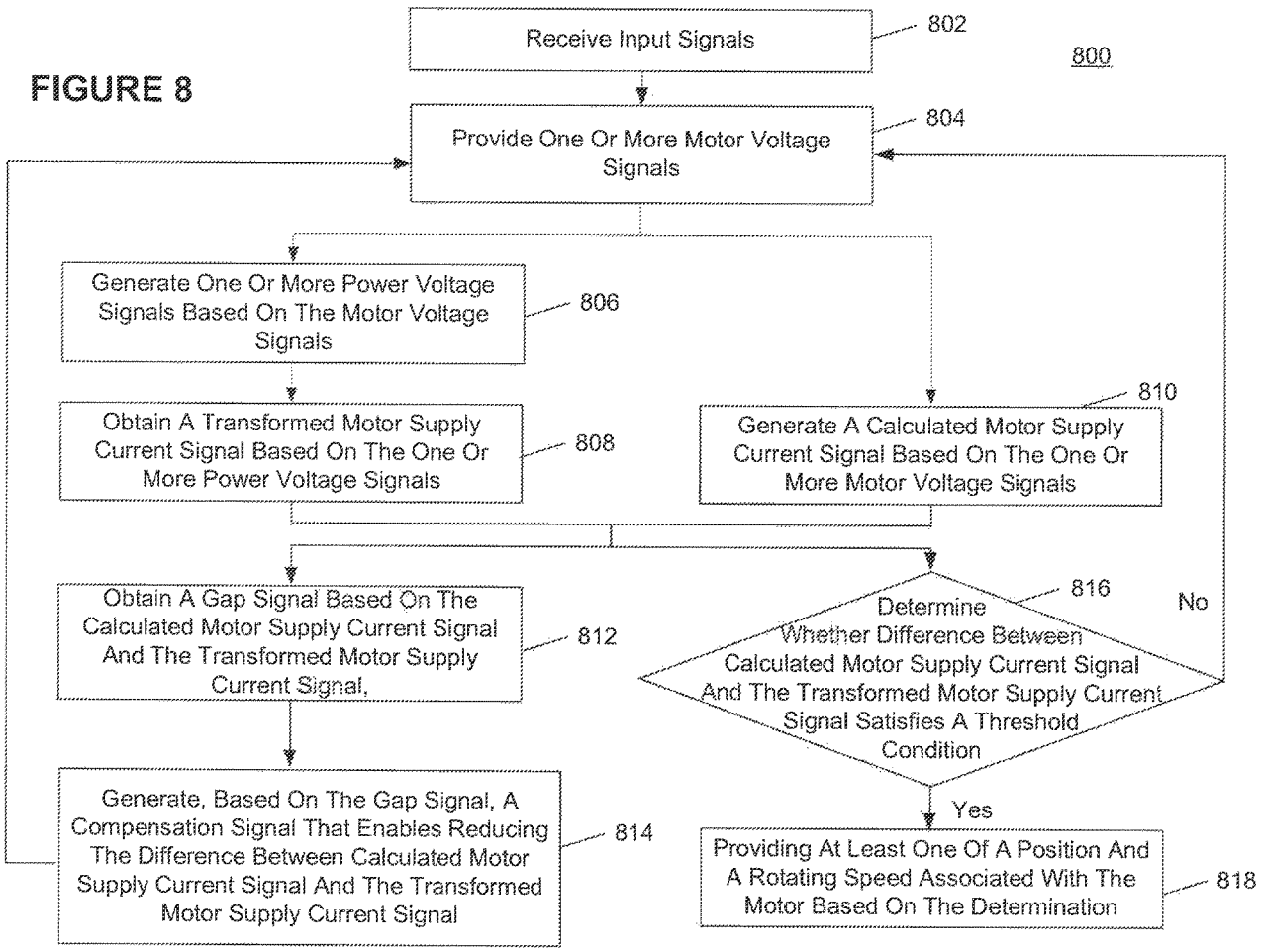
FIG. 8 is a flowchart illustrating an exemplary method for controlling a direct drive rotating motor.

FIG. 8 is a flowchart illustrating an exemplary method 800 for controlling a direct drive motor. Referring to FIG. 8, it will be readily appreciated by one of ordinary skill in the art that the illustrated procedure can be altered to delete steps or further include additional steps. In an initial step 802, a control system (e.g., control system 206, 320, 500, or 600) receives input signals. The input signals may be digital signals. In step 804, the control system may provide one or more motor voltage signals based on the input signals and/or feedback signals such as a compensation signal generated in step 812. The motor voltage signals may include one or more dedicated regulation voltages corresponding to the desired motor supply currents. The motor voltage signals may be analog signals.

In step 806, the control system may generate one or more power voltage signals based on the motor voltage signals. For example, the control system can convert the motor voltage signals, which may be DC signals, to a three-phase pulse width modulation voltage signal, which may be an AC power voltage signal.

As shown in FIG. 8, based on the one or more power voltage signals, the control system may obtain (step 808) a transformed motor supply current signal. In some embodiments, in step 808, the control system may measure or derive two phases of a motor supply current signal based on the one or more power voltage signals. The measured two-phase motor supply current signal may be analog signals and thus the control system may convert it to its digital representations. The control system may further apply a DQ transformation to the digital representations of the measured two-phase motor supply current signal to obtain the transformed motor supply current signal, which may be a digital signal with DC quantities.

Referring to FIG. 8, in some embodiments, the control system may also calculate information associated with the motor supply currents and generate (step 810) a calculated motor supply current signal. In some embodiments, the control system compares the transformed motor supply current signal with the calculated motor supply current signals and obtains (step 812) a gap signal. The gap signal may represent the difference of the calculated motor supply currents and measured motor supply currents. Based on the gap signal, the control system can generate (step 814) a compensation signal that enables reducing of the difference between the calculated motor supply currents and measured motor supply currents. The compensation signal can be sent to step 804 for providing the next motor voltage signals. The steps for reducing the difference between the calculated motor supply currents and measured motor supply currents may be repeated.

Referring to FIG. 8, at step 816, the control system can determine whether the difference between the calculated motor supply currents and measured motor supply currents satisfies a threshold condition (e.g., less than a threshold quantity). When the difference between the calculated motor supply currents and measured motor supply currents does not satisfy a threshold condition, the control system can repeat step 804 and other steps described above. When the difference between the calculated motor supply currents and measured motor supply currents satisfies a threshold condition, the control system can provide (step 818) the position (e.g., the angle of an inner rotor of the direct drive motor) and the speed (e.g., the speed of a magnetic modulation ring or the speed of output shaft of the direct drive motor) information associated with the direct drive motor.

The methods disclosed herein may be implemented as a computer program product, i.e., a computer program tangibly embodied in an information carrier, e.g., in a machine readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand alone program or as a module, component, subroutine, or other unit suitable for use in a computing environment. A computer program can be deployed to be executed on one computer or on multiple computers at one site or distributed across multiple sites and interconnected by a communication network.

In the foregoing specification, embodiments have been described with reference to numerous specific details that can vary from implementation to implementation. Certain adaptations and modifications of the described embodiments can be made. Other embodiments can be apparent to those skilled in the art from consideration of the specification and practice of the invention disclosed herein. It is intended that the specification and examples be considered as exemplary only, with a true scope and spirit of the invention being indicated by the following claims. It is also intended that the sequence of steps shown in figures are only for illustrative purposes and are not intended to be limited to any particular sequence of steps. As such, those skilled in the art can appreciate that these steps can be performed in a different order while implementing the same apparatus or method.

We claim:

1. A method for controlling a rotating motor of a beam pumping unit that includes one or more cranks coupled to a walking beam enabling extraction of underground objects, comprising:

receiving, at a control system, one or more input signals representing desired motor supply currents for operating the rotating motor;

providing, based on the input signals, one or more control signals to the rotating motor to enable the rotating motor to directly drive the one or more cranks for extracting the underground objects;

varying, based on the one or more control signals, a rotating speed of the rotating motor based on one or more conditions of the underground objects; and enabling the extraction in a reciprocated manner based on the varying rotating speed of the rotating motor;

wherein providing the one or more control signals comprises determining at least one of a position or a rotating speed associated with the motor in absence of a position sensor; providing one or more motor voltage signals corresponding to the desired motor supply currents; and generating one or more power voltage signals based on the one or more motor voltage signals, and the method further comprises obtaining a two-phase motor supply current signal based on the one or more power voltage signals, the two-phase motor supply current signals being analog signals;

generating digital representations of the two-phase motor supply current signal using the obtained two-phase motor supply current signal;

applying a DQ transformation to the digital representations of the two-phase motor supply current signals to obtain a transformed motor supply current signal;

generating a calculated motor supply current signal based on the one or more motor voltage signals;

obtaining a gap signal based on the calculated motor supply current signal and the transformed motor supply current signal, the gap signal representing the difference between calculated motor supply current signal and the transformed motor supply current signal; and generating, based on the gap signal, a compensation signal that enables reducing the difference between calculated motor supply current signal and the transformed motor supply current signal.

2. The method of claim 1, wherein the rotating motor is at least one of: a permanent magnet synchronous motor, a synchronous reluctance motor, a compound permanent magnet synchronous motor, a brushless motor, a direct current motor, a rotor winding synchronous motor, an asynchronous motor, or an inductance motor.

3. The method of claim 1, wherein the one or more power voltage signals include a three-phase pulse width modulation (PWM) voltage signal.

4. The method of claim 1, further comprising:

determining whether difference between calculated motor supply current signal and the transformed motor supply current signal satisfies a threshold condition; and providing at least one of a position or a rotating speed associated with the motor based on the determination.

5. The method of claim 1, further comprising:

obtaining one or more parameters associated with the rotating motor, the one or more parameters including at least one of: a rotor angle, a rotation speed, a rotor resistance, a stator resistance, a leakage inductance, a d-axis reactance, a q-axis reactance, nominal supply currents, a nominal torque, magnetic fields coefficients, or one or more parameters of a Kalman filter including noise covariances.

6. The method of claim 5, wherein obtaining the one or more parameters associated with the motor is based on a two-phase motor supply current signal.

7. The method of claim 1, wherein extracting the underground objects in the reciprocated manner comprising:

providing an up and down motion based on the varying rotating speed of the rotating motor, wherein the up motion has a first speed and the down motion has a second speed.

8. The method of claim 7, wherein the first speed is greater than or equal to the second speed.

9. A non-transitory computer-readable storage medium storing instruction, when executed by one or more processors, causing a beam pumping unit to perform a method for controlling a rotating motor of the beam pumping unit that includes one or more cranks coupled to a walking beam enabling extraction of underground objects, wherein the method comprises:

receiving, at a control system, one or more input signals representing desired motor supply currents for operating the rotating motor;

providing, based on the input signals, one or more control signals to a rotating motor to directly drive one or more cranks for extracting the underground objects;

varying, based on the one or more control signals, a rotating speed of the rotating motor based on one or more conditions of the underground objects; and enabling the extraction in a reciprocated manner based on the varying rotating speed of the rotating motor;

wherein providing the one or more control signals comprises determining at least one of a position or a rotating speed associated with the motor in absence of a position sensor; providing one or more motor voltage signals corresponding to the desired motor supply currents; and generating one or more power voltage signals based on the one or more motor voltage signals, and the method further comprises obtaining a two-phase motor supply current signal based on the one or more power voltage signals, the two-phase motor supply current signals being analog signals;

generating digital representations of the two-phase motor supply current signal using the obtained two-phase motor supply current signal;

applying a DQ transformation to the digital representations of the two-phase motor supply current signals to obtain a transformed motor supply current signal;

generating a calculated motor supply current signal based on the one or more motor voltage signals;

obtaining a gap signal based on the calculated motor supply current signal and the transformed motor supply current signal, the gap signal representing the difference between calculated motor supply current signal and the transformed motor supply current signal; and generating, based on the gap signal, a compensation signal that enables reducing the difference between calculated motor supply current signal and the transformed motor supply current signal.

10. The computer-readable storage medium of claim 9, wherein the one or more power voltage signals include a three-phase pulse width modulation (PWM) voltage signal.

11. The computer-readable storage medium of claim 9, wherein the set of instructions that are executable by the one or more processors to cause the beam pumping unit to further perform:

determining whether difference between calculated motor supply current signal and the transformed motor supply current signal satisfies a threshold condition; and providing at least one of a position or a rotating speed associated with the motor based on the determination.

12. The computer-readable storage medium of claim 9, wherein the set of instructions that are executable by the one or more processors to cause the beam pumping unit to further perform:

obtaining one or more parameters associated with the motor, the one or more parameters including at least one of: a rotor angle, a rotation speed, a rotor resistance, a stator resistance, a leakage inductance, a d-axis reactance, a q-axis reactance, nominal supply currents, a nominal torque, magnetic fields coefficients, or one or more parameters of a Kalman filter including noise covariances.

* * * * *